US006435836B1

(12) United States Patent
Kobayashi et al.

(10) Patent No.: US 6,435,836 B1
(45) Date of Patent: Aug. 20, 2002

(54) FLUID MACHINERY

(75) Inventors: Makoto Kobayashi; Masakazu Yamamoto; Yoshio Miyake; Junya Kawabata; Keita Uwai; Yoshiaki Miyazaki; Katsuji Iijima, all of Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/600,866

(22) PCT Filed: Feb. 5, 1999

(86) PCT No.: PCT/JP99/00499

§ 371 (c)(1),
(2), (4) Date: Sep. 29, 2000

(87) PCT Pub. No.: WO99/40322

PCT Pub. Date: Aug. 12, 1999

(30) Foreign Application Priority Data

Feb. 9, 1998 (JP) ..... 10-042869
May 26, 1998 (JP) ..... 10-161326

(51) Int. Cl.[7] ..... F09B 49/00
(52) U.S. Cl. ..... 417/12; 417/32
(58) Field of Search ..... 417/12, 32, 44.1

(56) References Cited

U.S. PATENT DOCUMENTS 5,352,095 A * 10/1994 Tanaka et al. ..... 417/12
5,509,786 A * 4/1996 Mizutani et al. ..... 417/32

FOREIGN PATENT DOCUMENTS

| | | |
|---|---|---|
| JP | 53-122125 | 10/1978 |
| JP | 56-35203 | 4/1981 |
| JP | 56-74282 | 6/1981 |
| JP | 62-99688 | 5/1987 |
| JP | 62-225797 | 10/1987 |
| JP | 2-104994 | 4/1990 |
| JP | 4-279778 | 10/1992 |
| JP | 6-10840 | 1/1994 |
| JP | 6-259146 | 9/1994 |
| JP | 6-76665 | 10/1994 |
| JP | 8-144961 | 6/1996 |
| JP | 8-219058 | 8/1996 |

* cited by examiner

*Primary Examiner*—Charles G. Freay
(74) *Attorney, Agent, or Firm*—Oblon, Spivak, McClelland, Maier & Neustadt, P.C.

(57) ABSTRACT

The present invention relates to a pump for delivering under pressure various liquids including water. The temperature of the handled liquid in a pump casing (1) is detected by a thermistor (51). If an increase in the temperature per time of the handled liquid is greater than a predetermined value, then the pump is shut down, or the flow rate or pressure of the liquid is changed depending on the temperature of the handled liquid detected by the thermistor based on a predetermined control program.

4 Claims, 6 Drawing Sheets

FLUID MACHINERY

TECHNICAL FIELD

The present invention relates to a fluid machine such as a pump or the like, and more particularly to a fluid machine which detects the temperature of a fluid being handled, prevents shut-off operation of a pump or the like, or changes the flow rate or pressure of the fluid based on the detected temperature of the fluid being handled.

BACKGROUND ART

Generally, when the shut-off operation of a pump is carried out for a long period of time, the pump causes trouble. Specifically, since the liquid being handled by the pump is expanded by a rise in the temperature of the liquid in the pump, the pressure in the pump increases, resulting in damage to the pump casing.

It is also known that when the handled liquid is evaporated and atomized, the service life of a mechanical seal and a gland packing is reduced. If the pump is of such a structure that the handled liquid is used to lubricate bearings and cool the motor, then the evaporated and atomized liquid also reduces the service life of the bearings and the motor. Heretofore, if the shut-off operation of a pump is unavoidable due to system requirements, then it has been customary to protect the pump with a relief pipe or the like in the shut-off operation.

However, when the relief pipe is used, it may accidentally bring about shut-off operation due to a rust based clog in the relief pipe or erroneous operation of the valve of the relief pipe.

Facilities for producing cooling water with a cooling tower and a circulating pump are continuously operated irrespective of the temperature of the liquid, and often consume more electric power than necessary.

There is also a system in which some units, i.e., a fan and a pump of a cooling tower, are operated when the temperature of the liquid rises, and they are shut down when the temperature of the liquid falls. Though this system is a better energy saver than the former facilities, it may fail to supply desired cooling water because the temperature of the liquid varies depending on the temperature settings for turning on and off the thermostat. If the range in which the temperature of the liquid is variable is reduced, then the above units need to be started and shut down more frequently, and hence suffer maintenance problems.

DISCLOSURE OF INVENTION

In view of the above conventional problems, it is a first object of the present invention to provide a method of preventing the shut-off operation of a pump for protecting the pump from the shut-off operation, and a pump unit which employs such method.

A second object of the present invention is to provide a fluid machine which. recognizes the temperature of a fluid by itself and employs the recognized temperature in coordination with the flow rate or pressure of the fluid to allow the entire system to save more energy.

To achieve the first object described above, in a method of preventing shut-off operation of a pump according to a first aspect of the present invention, the temperature of a handled liquid in the pump is detected, and the pump is shut down if an increase in the temperature per time of the handled liquid is greater than a predetermined value.

According to the first aspect of the present invention, the pump is reliably protected from shut-off operation. When the pump is operated normally, it should not be operated in error. In applications for circulating hot water, the temperature of the handled liquid passing through the pump may abruptly change as in the following case. For example, at the same time that the pump is actuated, hot water is supplied from a heat source on a suction side.

For preventing the pump from being operated in error, in a method of preventing shut-off operation of a pump according to a second aspect of the present invention, a temperature of a handled liquid in the pump is measured in a predetermined time ($\Delta T$) at a plurality of (N) times, and the pump is shut down if an increase in the temperature across the predetermined time is greater than a predetermined value ($\Delta t$) at (N−1) times.

The method according to the second aspect of the present invention is capable of preventing the pump from being operated in error.

specifically, the temperature of the handled liquid is measured N times, e.g., six times, each in the predetermined time ($\Delta T$), e.g., 1 minute. If all the temperature differences between first and second measurements, second and third measurements, third and fourth measurements, fourth and fifth measurements, and fifth and six measurements are 2° C. or higher, then the pump is shut down. In this manner, even if the temperature of the handled- liquid is changed (increased) transiently in normal operation of the pump, the pump is prevented from being shut down in error.

In order to recognize the gradient of the increase in the temperature of the handled liquid in the pump, it is necessary to measure the temperature at least across, i.e., before and after, the predetermined time. Therefore, it is time-consuming to recognize the gradient of the increase in the temperature of the handled liquid. However, if a shut-off operation of the pump occurs while the pump is operating at the upper limit of the temperature range according to pump specifications, then the pump needs to be shut down as soon as possible because the temperature of the liquid in the pump exceeds the specification range in a short period of time.

In a method of preventing shut-off operation of a pump according to a third aspect of the present invention, the pump is shut down if a temperature of the handled liquid in the pump, other than the increase in the temperature per time of the handled liquid, becomes equal to or higher than a predetermined value (T). In this manner, the pump is protected from suffering the above problems.

A pump unit according to an aspect of the present invention has a pump, a motor for actuating the pump, a temperature detecting device for detecting the temperature of a handled liquid in the pump, and a control circuit electrically connected to the temperature detecting device for controlling operation of the motor; wherein the pump is shut down if an increase in the temperature, detected by the temperature detecting device, per time of the handled liquid is greater than a predetermined value.

In this invention, the pump unit has a frequency converter assembly for supplying electric power to the motor, the control circuit being disposed in the frequency converter assembly.

Recently, there have been used pump units having a pump, a motor, and a frequency converter (inverter) that are integrally combined with each other. These pump units are products that are primarily designed as an energy saver. In such a pump unit, a temperature detecting device is disposed in a pump casing, and connected to the control circuit in the frequency converter assembly for protecting the pump from shut-off operation.

Since the frequency converter has a circuit for storing and processing supplied information to control an output signal to the motor, it is easy to protect the pump by recognizing the gradient of the increase in the temperature of the handled liquid, as described above.

According to another aspect of the present invention, a pump unit for shutting down a pump after a shut-off operation of the pump when the amount of liquid supplied from the pump is reduced, characterized in that the temperature of a handled liquid in the pump is detected, and the pump is shut down if an increase in the temperature per time of the handled liquid is greater than a predetermined value.

In order to achieve the above second object, a fluid machine for delivering a fluid according to an aspect of the present invention, characterized in that a flow rate or pressure of the fluid is changed depending on the temperature of the fluid or the change in the temperature of the fluid based on a predetermined control program.

In the fluid machine according to the present invention, since the temperature of the handled fluid is recognized, and the flow rate or pressure of the fluid can be changed depending on the temperature of the fluid or the change in the temperature of the fluid, the energy consumed by the overall system can be saved. In a preferred aspect, the flow rate or pressure of the fluid is changed in order to keep the temperature of the fluid substantially constant. The flow rate or pressure of the fluid is changed by adjusting the rotational speed of the fluid machine which is a turbo-type fluid machine.

In the fluid machine according to the present invention, a target reference temperature for the fluid is predetermined, and the actual temperature of the handled fluid is detected by the temperature detecting device. If there is a difference between the reference temperature and the actual temperature of the fluid, then the rotational speed of the fluid machine is increased or decreased to reduce the difference between the reference temperature and the actual temperature of the fluid.

According to a preferred aspect of the present invention, a fluid machine is characterized by a pump unit comprising a pump, a motor for actuating the pump, and a frequency converter assembly for controlling the motor to change its speed, and further characterized by a temperature detecting device disposed in the pump unit, the arrangement being such that a signal from the temperature detecting device is supplied to a controller in the frequency converter assembly. A switch is disposed in the frequency converter assembly for changing the reference temperature stepwise.

According to an aspect of the present invention, a temperature detecting device for detecting the temperature of air is separately disposed around the fluid machine, and the preset reference temperature is automatically changed based on a detected signal from the temperature detecting device. In this structure, the fluid machine can be operated in view of the temperature of the ambient air for allowing the overall system to save more energy.

BEST MODE FOR CARRYING OUT THE INVENTION

Figure 1:
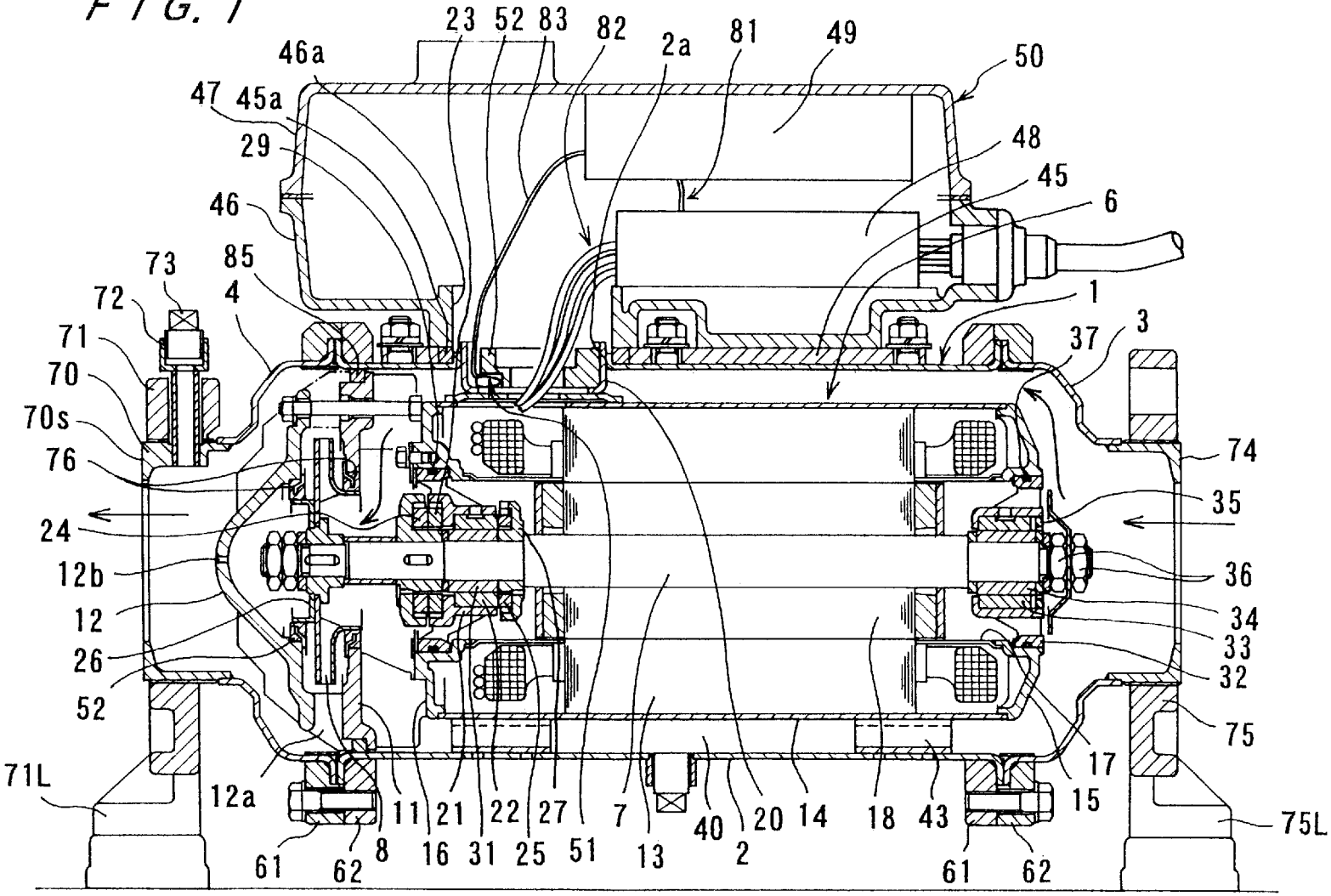
FIG. 1 is a cross-sectional view showing a first embodiment of a pump unit according to the present invention.

An embodiment of a pump unit according to the present invention will be described below with reference to FIG. 1. FIG. 1 is a cross-sectional view of a full-circumferential flow motor pump as an embodiment of a pump unit according to the present invention.

The full-circumferential flow motor pump has a pump casing 1, a canned motor 6 housed in the pump casing 1, and an impeller 8 fixed to an end of a main shaft 7 of the canned motor 6. The pump casing 1 comprises an outer cylinder 2, and a suction casing 3 and a discharge casing 4 which are connected respectively to the opposite ends of the outer cylinder 2 by casing flanges 61, 62. The casing flanges 61, 62 comprise loose ring-shaped casing flanges by which the suction casing 3 and the discharge casing 4 are fixed to the outer cylinder 2. The outer cylinder 2, the suction casing 3, and the discharge casing 4 are made of sheet metal such as stainless steel.

A bracket 45 is mounted on an outer circumferential surface of the outer cylinder 2, and a frequency converter assembly 50 is mounted on the bracket 45. The frequency converter assembly 50 comprises a base 46 attached to the bracket 45, a cover 47 attached to the base 46, a frequency converter (inverter) 48 surrounded by the base 46 and the cover 47, and a control circuit 49. The frequency converter 48 and the control circuit 49 are connected to each other by a signal line 81.

The bracket 45 and the base 46 have respective holes 45*a*, 46*a* defined therein through which the canned motor 6 and the frequency converter 48 are electrically connected to each other by leads 82. The bracket 45, the base 46, and the cover 47 are made of a good heat conductor of aluminum alloy.

The canned motor 6 comprises a stator 13, a motor frame outer barrel 14 disposed around the stator 13, motor frame side plates 15, 16 welded to open ends of the motor frame outer barrel 14, and a can 17 fitted in the stator 13 and welded to the motor frame side plates 15, 16. A rotor 18 rotatably disposed in the stator 13 is shrink-fitted over the main shaft 7. An annular space (flow path) 40 is defined between the motor frame outer barrel 14 and the outer cylinder 2.

A guide member 11 for guiding a fluid radially inwardly is held by the motor frame side plate 16 of the canned motor 6. The impeller 8 is housed in an inner casing 12 that is fixed to the guide member 11. A seal member 85 is disposed on an outer circumferential portion of the guide member 11.

Liner rings 76 are mounted on inner ends of the guide ring 11 and are slidable against a front surface (suction mouth side) of the impeller 8. The inner casing 12 is substantially dome-shaped and covers an end of the main shaft 7 of the canned motor 6. The inner casing 12 has a guide device 12*a* comprising a guide vane or volute for guiding the fluid discharged from the impeller 8. The inner casing 12 also has an air vent hole 12*b* defined in a tip end thereof.

A terminal case 20 is fixed to the motor frame outer barrel 14 by welding. The leads 82 extend outwardly from the coils in the motor frame outer barrel 14 through the terminal case 20, and are connected to the frequency converter (inverter) 48 in the base 46 and the cover 47 via the hole 45 *a* in the bracket 45 and the lead passage hole 46 *a* in the base 46. The outer cylinder 2 has a hole 2*a* defined therein in which the terminal case 20 is inserted. The terminal case 20 houses therein a thermistor 51 as a temperature detecting device. The thermistor 51 is fixed in position by a rubber bushing 52. The thermistor 51 is connected to the control circuit 49 by a signal line 83.

Bearings and associated parts near the impeller 8 will be described below.

A bearing bracket 21 supports a radial bearing 22 and a fixed thrust bearing 23. The radial bearing 22 has an end face serving as a fixed thrust sliding member. Rotary thrust bearings 24, 25 as rotary thrust sliding members are disposed on opposite sides of the radial bearing 22 and the fixed thrust bearing 23. The rotary thrust bearing 24 is fixed to a thrust disk 26 that is fixed to the main shaft 7 by a key. The rotary thrust bearing 25 is fixed to a thrust disk 27 that is fixed to the main shaft 7 by a key.

The bearing bracket 21 is inserted in a socket defined in the motor frame side plate 16 with an O-ring 29 of an elastomeric material interposed therebetween. A sleeve 31 serves as a sliding member against which the radial bearing 22 slides.

Bearings and associated parts remote from the impeller 8 will be described below.

A bearing bracket 32 supports a radial bearing 33. A sleeve 34 serves as a sliding member against which the radial bearing 33 slides. The sleeve 34 is held against a seat 35 that is fixed in position by two nuts 36 threaded over a threaded end of the main shaft 7. The bearing bracket 32 is inserted in a socket defined in the motor frame side plate 15 with an O-ring 37 of an elastomeric material interposed therebetween.

Stays 43 are welded to the motor frame outer barrel 14. The stays 43 are fixed to the outer cylinder 2 by welding. The canned motor 6 is rotatable at a speed of 4000 rpm or more by the frequency converter 48 that converts the frequency of a commercially available power supply into a higher frequency.

A discharge nozzle 70 is fixed to the discharge casing 4 by welding. The discharge nozzle 70 comprises an annular member having a large outside diameter and a large wall thickness. The discharge nozzle 70 is made of stainless steel or the like which is the same as the material of the pump casing, and has a front end face serving as a sealing surface 70*s* for mating with a companion flange (not shown). A discharge flange 71 fixed to the discharge nozzle 70 is made of a material different from the material of the pump casing, e.g., cast iron (FC) or the like, and is threaded over the discharge nozzle 70. As shown in FIG. 1, the discharge flange 71 has an upper portion partly beveled. An installation leg 71L is integrally formed on the discharge flange 71.

A pressure pickup pipe 72 has a distal end threaded in the discharge nozzle 70. A plug 73 is removably attached to the pressure pickup pipe 72. The pressure pickup pipe 72 is mounted on the discharge flange 71 at its beveled position out of alignment with a maximum-outside-diameter portion thereof. When the plug 73 is removed and a pressure gage is attached to the pressure pickup pipe 72, the discharge pressure in the discharge nozzle 70 can be measured.

As shown in FIG. 1, a suction nozzle 74 is fixed to the suction casing 3 of the pump casing, and a suction flange 75 is fixed to the suction nozzle 74. A leg 75L is integrally formed on the suction flange 75. The discharge flange 71 and the suction flange 75 have outside diameters greater than the inside diameters of the casing flanges 61, 62.

Operation of the full-circumferential flow motor pump shown in FIG. 1 will briefly be described below. The fluid drawn from the suction nozzle 74 connected to the suction casing 3 flows through the suction casing 3 into the annular flow path 40 defined between the outer cylinder 2 and the motor frame outer barrel 14 of the canned motor 6, passes through the annular flow path 40, and is guided by the guide member 11 into the impeller 8. The fluid discharged from the impeller 8 flows through the guide device 12*a*, and is discharged from the discharge nozzle 70 connected to the discharge casing 4.

In the present embodiment, the thermistor 51 as a temperature detecting device is disposed in the terminal assembly of the full-circumferential flow motor pump, and fixed in position by the rubber bushing 52. The rubber bushing 52 is effective to reduce the heat of the frequency converter 48 transmitted to the thermistor 51. Therefore, the temperature of the handled liquid in the pump can accurately be determined. Since the terminal assembly is positioned intermediate between the motor stator 31 and the frequency converter 48 and faces the flow path, the temperature of the handled liquid in the pump can accurately be detected. The present invention is based on the fact that the temperature of the liquid in the pump abruptly increases in the shut-off operation of the pump, and shuts down the pump when the gradient of the temperature increase is sharp. Specifically, if the temperature increase per time is 2° C. per minute, for example, the pump is shut down. Therefore, the pump can reliably be protected.

The terminal case 20 of the terminal assembly is made of metal (thin sheet of stainless steel), and can well transmit the temperature of the handled liquid in the pump to the thermistor 51 in the terminal case 20. The thermistor 51 thus installed with such care is electrically connected to the control circuit (board) 49 in the frequency converter assembly 50 for reliable prevention of the shutoff operation of the pump.

In the shut-off operation of the full-circumferential flow motor pump, the temperature of the handled liquid in the pump increases with the heat generated by the motor as well as the heat generated by the pump assembly. As with the embodiment shown in FIG. 1, the frequency converter mounted on an outer surface of the full-circumferential flow motor pump is effectively cooled by the handled liquid in normal operation of the pump, but the heat generated by the frequency converter is also transferred to the handled liquid. Therefore, the temperature of the handled liquid in the full-circumferential flow motor pump is more liable to increase than the ordinary pump in the shut-off operation. Therefore, it is highly effective to protect the pump with the method of preventing the shut-off operation of the pump according to the present invention.

Furthermore, the full-circumferential flow motor pump shown in FIG. 1 has its pump assembly and motor operable at high speed and reduced in size by the use of the frequency converter. Since the flow rate of water in the pump to the amount of work done by the pump/motor and the frequency converter is relatively small, the gradient of the temperature rise in the shut-off operation is large. Therefore, the present invention is particularly effective in the full-circumferential flow motor pump.

It is important to shut down the pump for protection against use of the pump at liquid temperatures outside its specifications as well as the shut-off operation. Therefore, if the temperature of the handled liquid as detected by the thermistor 51 falls out of the specification range, then the control circuit 49 in the frequency converter assembly 50 shuts down the pump.

The process of recognizing the shut-off operation based on the gradient of a temperature rise is also important from another standpoint. Specifically, a water supply apparatus generally employs a process of shutting down the pump with a flow switch and a timer when the pump is used at a low flow rate. However, this process suffers the problem of undue wear of contacts of the flow switch.

According to the present invention, since the contactless thermistor 51 is used to detect the gradient of a temperature rise of the handled liquid in the pump for shutting down the pump, the process according to the present invention is preferable from a durability standpoint. In full-circumferential flow motor pumps and high-speed, small-size pumps, the gradient of a temperature rise of the handled liquid can easily be detected as it is sharp in the shut-off operation.

Based on the above function of the thermistor to detect the temperature of the handled liquid, the flow switch used in the water supply apparatus may be replaced with the thermistor. Specifically, if the flow rate of liquid discharged from the pump becomes equal to or smaller than a prescribed flow rate, then since the temperature of the handled liquid is increased, the temperature rise is detected by the thermistor to shut down the pump.

In the method of preventing the shut-off operation of a pump according to the present invention, as described above, the temperature of the handled liquid in the pump is detected, and if an increase in the temperature of the handled liquid is sharp or if the temperature of the handled liquid falls out of the specification range, then the pump is shut down. Therefore, the shut-off operation of the pump can reliably be prevented from occurring.

An embodiment of a fluid machine according to the present invention will be described below.

Figure 2:
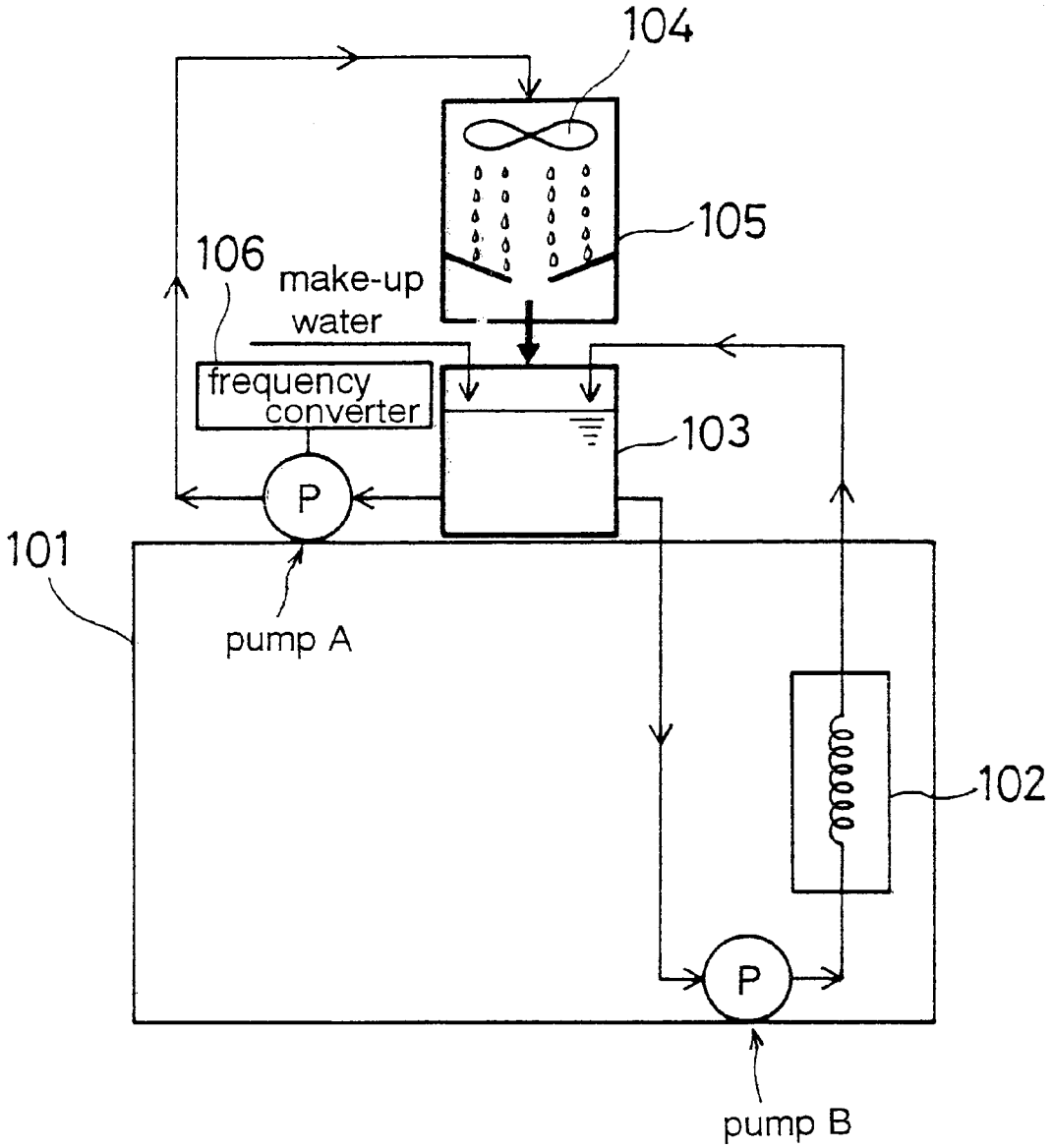
FIG. 2 is a schematic diagram showing an embodiment of a fluid machine according to the present invention.

FIG. 2 shows a cooling water production facility comprising a cooling tower and a circulating pump (pump A). A cooling water produced by the facility is supplied to fan coil units 102 installed in various places in a building 101 by a pump B. The supplied cooling water cools rooms in the building 101, and returns, with its temperature increased, to a water tank 103 installed outside of the building 101, e.g., on the roof of the building 101. The pump A corresponds to the fluid machine according to the present invention. The water in the water tank 103 is delivered under pressure by the pump A to a cooling tower 105 having a fan 104. After the water is cooled by the cooling tower 105, it returns to the water tank 103. The water tank 103 is supplied with make-up water.

According to the present invention, in order to achieve the second object described above, the fluid machine that comprises the pump A is arranged to change the flow rate or pressure of the fluid in its operation depending on the temperature of the fluid or the change in the temperature of the fluid based on a predetermined control program. The arrangement of the fluid machine will be described below.

In FIG. 2, when the flow rate of the liquid delivered by the pump A increases, the cooling effect of the cooling tower 105 is increased, and hence the temperature of the water in the water tank 103 is lowered. Generally, the capacity of the pump A is selected with a margin in view of the aging of the pipes and other factors. As a result, the flow rate of the liquid in daily operation tends to become excessive, and the temperature of the water in the water tank 103 is liable to be lower than necessary. According to the present invention, the flow rate of the liquid through the pump A is controlled so as to be constant when the water temperature is about 32° C., (reference temperature), thus reducing the power consumption by the pump A.

In FIG. 2, the pump A, the pump B, and the fan 104 of the cooling tower 105 are also shut down in an initial state. At this time, the water temperature is 28° C., for example. If the building needs to be cooled, the pump B is started to be operated, and the water temperature gradually increases. When the water temperature exceeds the reference temperature (32°0 C.), the fan 104 of the cooling tower 105 and the pump A start operating. At this time, the pump A is operated at a relatively low rotational speed, e.g., a rotational speed which is 60 % of the rated speed, by a frequency converter (inverter) 106.

The fan 104 of the cooling tower 105 and the pump A continue operating for 5 minutes, for example. If the water temperature drops below the reference temperature after 5 minutes, then the pump A is continuously operated at the same rotational speed until the water temperature reaches 28° C., for example. When the water temperature reaches 28° C., the pump A and the fan 104 of the cooling tower 105 are shut down. If the water temperature further increases after 5 minutes, then the rotational speed of the pump A is increased. At this time, the pump A is operated at a rotational speed which is 65% of the rated speed, for example. By thus comparing the water temperature with the reference temperature in every 5 minutes to automatically change or maintain the rotational speed of the pump A, the temperature of the cooling water is kept at about 32° C., and the power consumption by the pump A is held to a minimum required.

In a system for producing hot water, unlike the system shown in FIG. 2, the control program is arranged such that the rotational speed of the pump A is decreased when the water temperature is increased, and increased when the water temperature is lowered. For example, the water temperature in such a system for producing hot water can be maintained at about 60° C.

In the above example, the relationship between the increase and decrease in the rotational speed of the pump A and the increase and decrease in the water temperature is already known. That is, in the example shown in FIG. 2, it is known that when the rotational speed is increased, the water temperature is lowered.

However, there are instances where the above relationship is unknown even though the reference temperature is determined. Stated otherwise, there is a system in which it is not known whether the water temperature is increased or decreased if the rotational speed is increased.

According to an aspect of the present invention, if there is a difference between a preset reference temperature and an actual fluid temperature, then the rotational speed is increased or decreased, and if the difference increases as a result, then the rotational speed is conversely decreased or increased. This process lends itself to a system where it is not known whether the water temperature is increased or decreased if the rotational speed is increased. For example, if the water temperature is higher than the reference temperature, then the rotational speed is temporarily increased though it is not known whether the rotational speed is to be increased or decreased in order to bring the water temperature closely to the reference temperature. If the water temperature increases as a result, then since it has become clear that the water temperature tends to differ more from the reference temperature when the rotational speed increases in the system, the rotational speed is conversely lowered. After the tendency of the increase or the decrease in the water temperature in relation to the increase or the decrease in the rotational speed has been known, the fluid temperature can be kept constant simply by changing the rotational speed through comparison between the reference temperature and the actual temperature every 5 minutes.

The pump unit shown in FIG. 1 is most suitable for use as the fluid machine according to the present invention, and effectively functions as the pump A shown in FIG. 2. The pump is a full-circumferential flow motor pump, and is constructed as a pump unit having a frequency converter assembly integral therewith.

The frequency converter assembly 50 that comprises the frequency converter 48 and the control circuit 49 has a switch capable of setting the reference temperature stepwise. For example, the switch can select a value of 40° C., 36° C., 32° C. 28° C., 25° –C., 20C., –5° C., or –10° C., as the reference temperature.

In the above cooling water producing system using the cooling tower, the value of 32° C., is selected as the reference temperature. As a result, the pump unit singly operates to increase or reduce its rotational speed, and keeps a constant rotational speed when the water temperature is about 32° C.

If the pump is used as a water supply pump in applications where the fluid temperature does not change even when the flow rate changes, then the switch may be set to a neutral position so that the above control process does not work.

The present invention further proposes a process of automatically setting the reference temperature based on a signal from a temperature detecting device for detecting air temperature. Specifically, a temperature detecting device for detecting air temperature is disposed near the pump unit, and the reference temperature is automatically set based on a detected signal from the temperature detecting device.

If the air temperature is high depending on the season, then the water temperature may not become lower than a certain value no matter how high the rate of circulating water in the cooling tower may be. In this case, the reference temperature setting is automatically increased to lower the power consumption by the pump. Even if the cooling effect is slightly lowered as a result, such a reduction in the cooling effect should be accepted in view of the recent trend in favor of more energy saving efforts.

Figure 3:
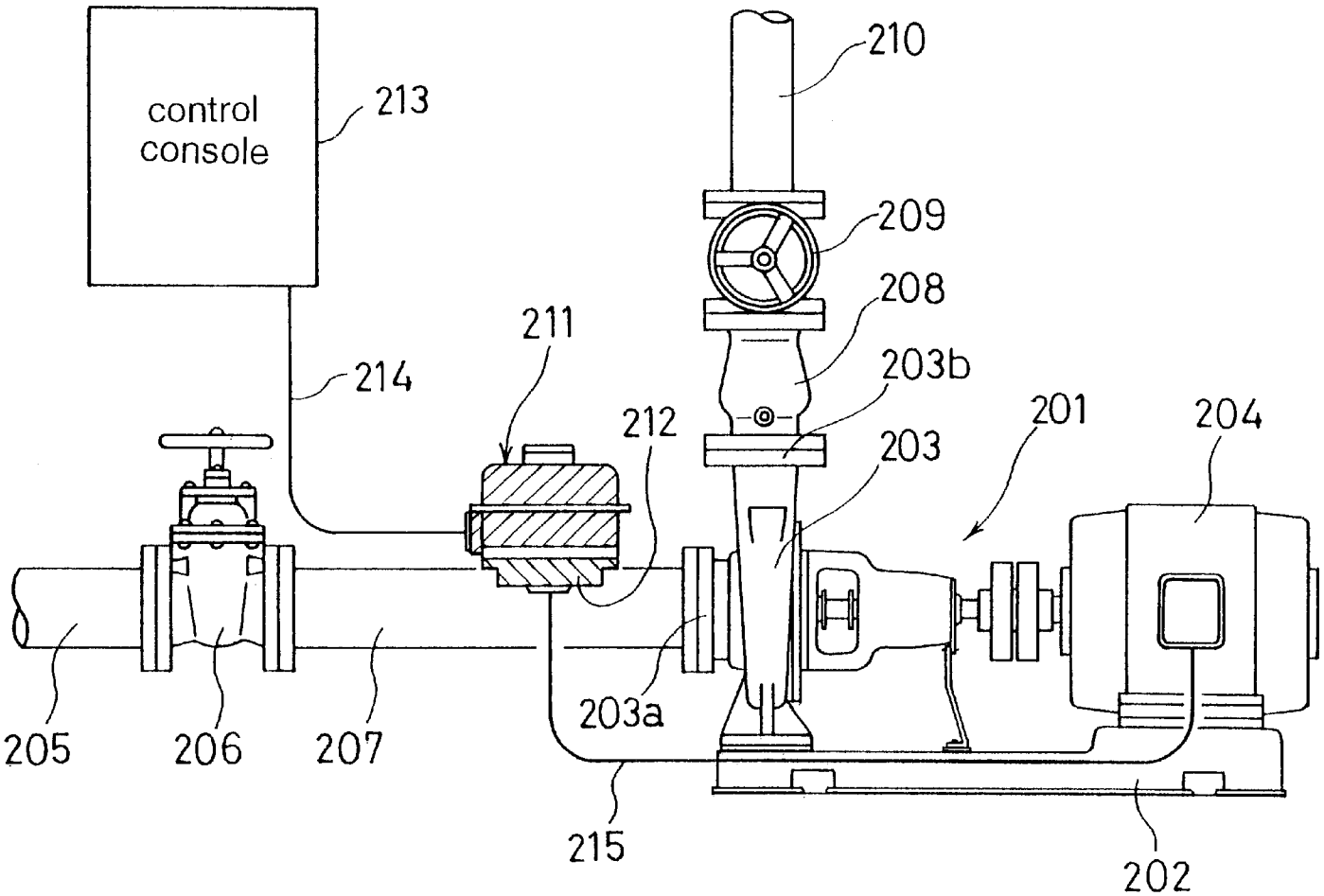
FIG. 3 is a view showing another preferred embodiment of a fluid machine according to the present invention.

FIG. 3 shows another preferred embodiment of a fluid machine according to the present invention.

A frequency converter assembly 211 is mounted on a surface of a pipe which guides a handled liquid. A temperature detecting device for detecting a liquid temperature is attached to a base 212 of the frequency converter assembly 211 near the bottom thereof. The temperature detecting device thus attached detects the liquid temperature relatively accurately. In FIG. 3, a pump unit 201 comprises a pump 203 and an electric motor 204 which are mounted on a common base 202. A fluid introduced from a suction pipe 205 passes through a suction gate valve 206 and a short pipe 207, is drawn into the pump 203 via a pump suction port 203*a*, increased in pressure, and then discharged from a pump discharge port 203*b*. The discharged fluid further passes through a check valve 208 and a discharge gate valve 209, and is introduced into a discharge pipe 210.

The frequency converter assembly 211 is mounted on the short pipe 207 by the base 212 that is made of aluminum alloy which has good heat conductivity.

In this embodiment, the base 212 is fixed to the frequency converter assembly 211 by bolts (not shown) and also fixed to the short pipe 207 by U bolts (not shown).

Electric power supplied from a control console 213 is applied from an input cable 214 as an input means of the frequency converter assembly 211 to a frequency converter in the frequency converter assembly 211, which converts the frequency of the supplied electric power. The electric power whose frequency has been converted is supplied from an output cable 215 as an output means of the frequency converter assembly 211 to the electric motor 204. The frequency converter in the frequency converter assembly 211 causes a heat loss, which is radiated into the liquid handled by the pump via the base 212 and the short pipe 207. The temperature detecting device for detecting the liquid temperature is attached to the base 212 near the bottom thereof, and detects the temperature of the handled liquid. The detected temperature is converted into a signal, which is supplied to a controller (not shown) in the frequency converter assembly 211.

Figure 4A:
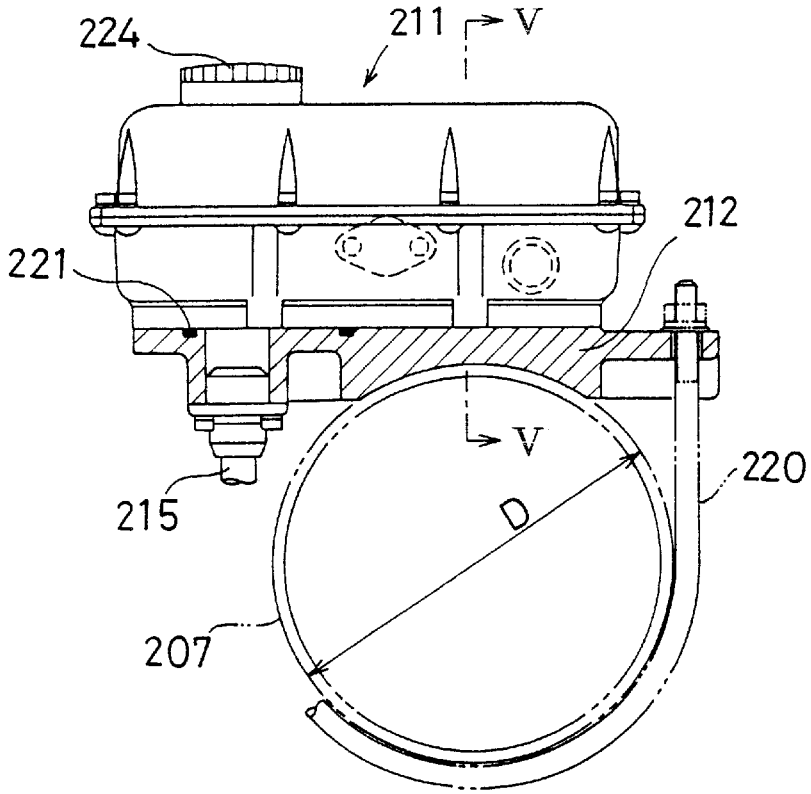
FIG. 4A is a front elevational view partly in cross section and 4B is a side elevational view, and both views are showing details of the device shown in FIG. 3.
Figure 4B:
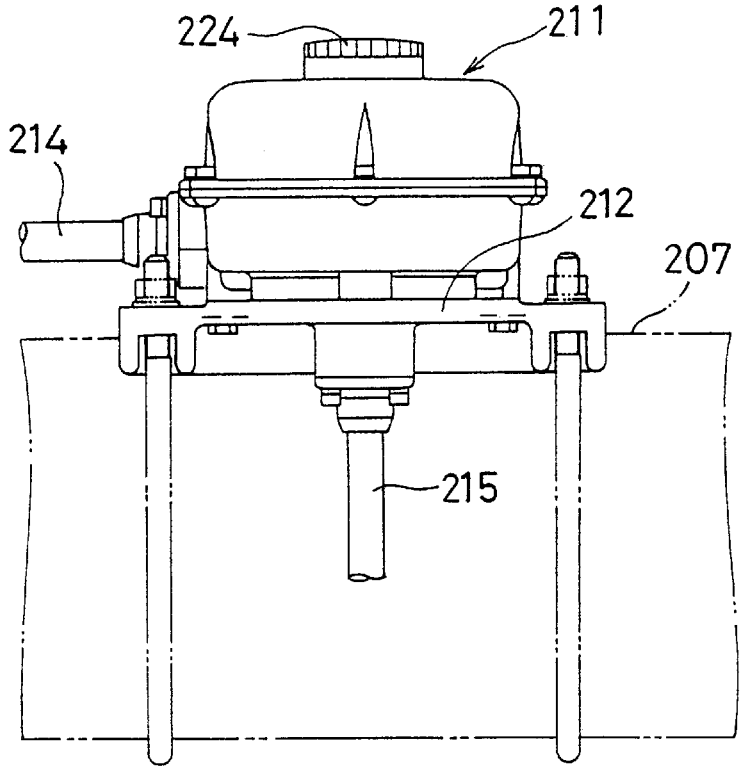

FIGS. 4A and 4B show the apparatus shown in FIG. 3 in detail. FIG. 4A is a front elevational view, partly in cross section, of the apparatus, and FIG. 4B is a side elevational view of the apparatus.

The base 212 is fixed to the short pipe 207 by U bolts 220. The input cable 214 and the output cable 215 keep the frequency converter assembly 211 hermetically sealed from the atmosphere in the same manner as with an underwater cable of a submersible motor pump, for example. An O-ring 221 is disposed to prevent ambient air from entering the apparatus through the mating surface between he base 212 and the frequency converter assembly 211.

Figure 5:
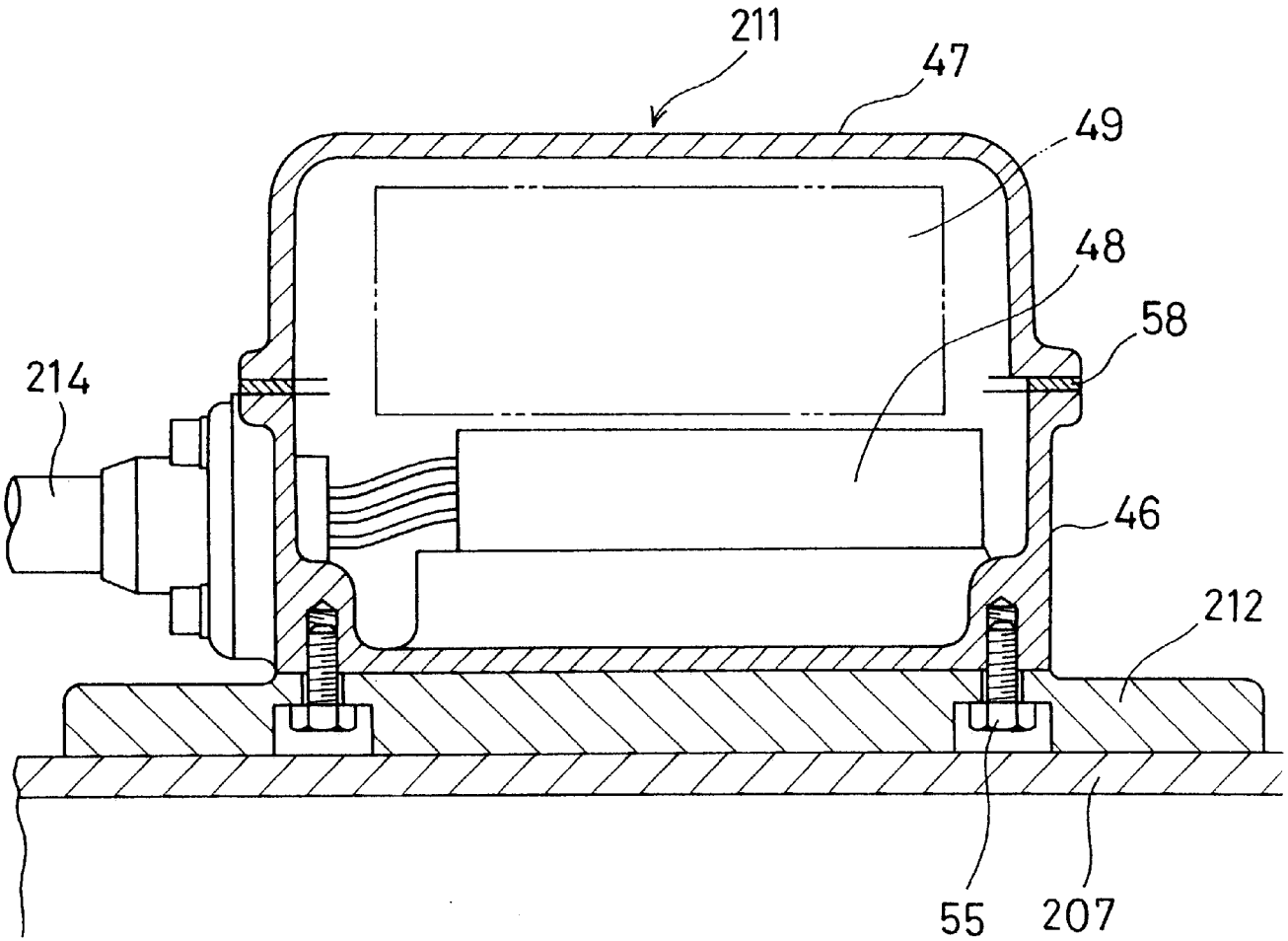
FIG. 5 is a cross-sectional view taken along line V—V of FIG. 4A.

A structure around the frequency converter assembly 211 will be described below with reference to FIG. 5 which is a cross-sectional view taken along line V—V of FIG. 4A. The frequency converter 48 is housed in a case which comprises the base 46 and the cover 47. The base 46 and the cover 47 are fixed to each other by bolts with a seal member 58 interposed therebetween, hermetically sealing the case from the ambient air.

The frequency converter 48 is highly intimately fixed to the base 46 to transfer the generated heat to the base 46. Similarly, the base 46 and the base 212, and the base 212 and the short pipe 207 are highly intimately fixed to each other. Since the heat generated by the frequency converter is suitably radiated into the handled fluid, the frequency converter assembly does not require an air-cooling fan for use in general inverters. Thus, the frequency converter assembly is free from insufficient cooling due to a fan failure. The base 46 and the base 212 are fastened to each other by bolts 55. Because the interior of the case is isolated from the ambient air, the frequency converter is prevented from insulation deterioration due to weathering and water condensation.

A threaded cap 224 serves to keep the frequency converter assembly hermetically sealed from the ambient air through an O-ring (not shown). The threaded cap 224 houses therein a switch for setting the reference temperature stepwise. For example, the switch comprises a rotary step switch for appropriately adjusting the reference temperature.

In the above embodiments, the present invention is applied to pumps. However, the principles of the present invention are also applicable to not only pumps, but also fans for forcibly air-cooling various machines and apparatus.

Figure 6:
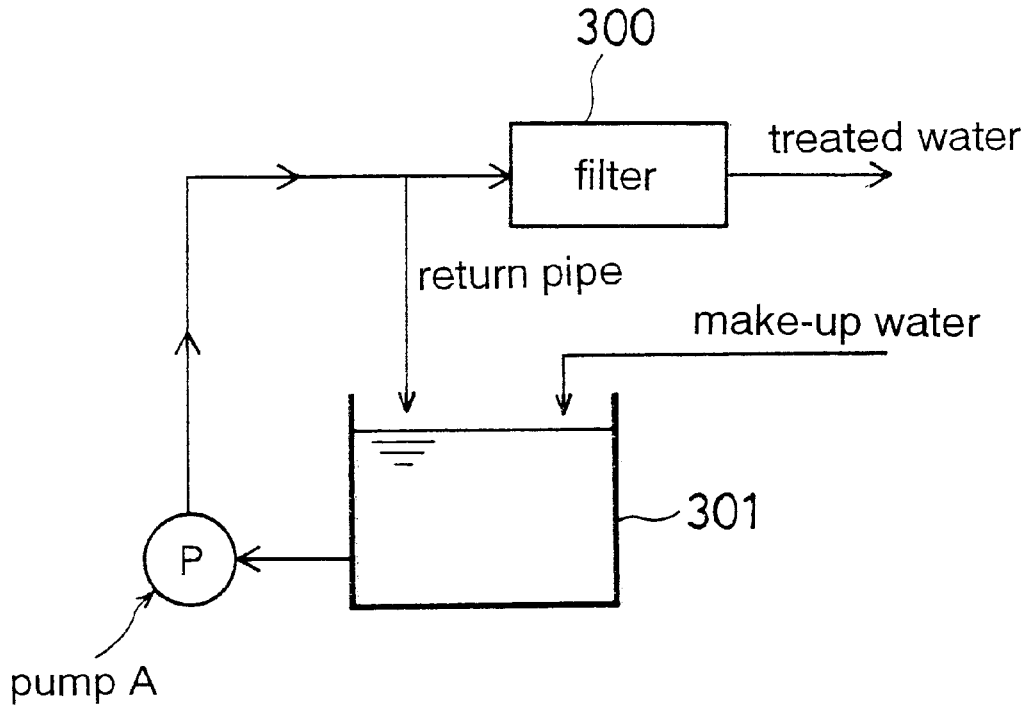
FIG. 6 is a diagram showing an embodiment where the present invention is applied to a water treatment system.

FIG. 6 shows an embodiment where the present invention is applied to a water treatment system.

The water treatment system uses a filter 300 for treating water. The water treatment system functions by establishing a pressure difference between the inlet and outlet of the filter

300. The resistance applied by the filter 300 to the passage of the fluid through the filter 300 greatly varies depending on the temperature of the liquid.

In order to equalize the amounts of treated water in summer and winter, it is necessary to change the pressure generated by a pump A for delivering treated water from a water tank 301 to the filter 300, i.e., to change the rotational speed of the pump A.

Heretofore, it has been customary to manually change the rotational speed of the pump depending on the season, but such a manual process has been tedious and time-consuming.

According to the present invention, pressures to be generated by the pump are determined in advance from liquid temperatures based on the relationship between the liquid temperatures and resistances applied by the filter 300 to the passage of the liquid through the filter, and stored in the control circuit 49 of the frequency converter of the pump shown in FIG. 1, for example.

As a consequence, even if the liquid temperature varies from time to time due to daily changes in the air temperature, the pump automatically regulates its generated pressure to produce treated water stably.

As described above, the fluid machine according to the present invention recognizes the temperature of a fluid by itself and employs the recognized temperature in coordination with the flow rate or pressure of the fluid to allow the entire system to save more energy.

Industrial applicability

The present invention is applicable to a fluid machine such as a pump for delivering a fluid under pressure, a fan for supplying a gas such as air, or the like.

What is claimed is:

1. A method of preventing shut-off operation of a pump, the method comprising:

measuring a temperature of a handled liquid in the pump in a predetermined time period ($\Delta T$) at a plurality of (N) times;

shutting down the pump if an increase in the temperature across the predetermined time period is greater than a predetermined value ($\Delta t$) at (N−1) times; and shutting down the pump if the temperature of the handled liquid in the pump, other than the increase in the temperature per time of the handled liquid, becomes equal to or higher than a predetermined value (t).

2. A pump unit comprising:

a pump;

a motor for actuating the pump;

a temperature detecting device for detecting a temperature of a handled liquid in the pump; and a control circuit electrically connected to the temperature detecting device for controlling operation of said motor;

wherein said pump is shut down if an increase in the temperature across the predetermined time period is greater than a predetermined value ($\Delta t$) at (N−1) times; and wherein said pump is shut down if the temperature of the handled liquid in the pump, other than the increase in the temperature per time of the handled liquid, becomes equal to or higher than a predetermined value (t).

3. A pump unit according to claim 2, further comprising a frequency converter assembly for supplying electric power to said motor, said control circuit being disposed in said frequency converter assembly.

4. A pump unit according to claim 3, further comprising an outer cylinder defining an annular flow path around a stator of the motor, and a terminal assembly for supplying electric power from around the outer cylinder to windings of the stator, said frequency converter assembly being disposed near said terminal assembly on an outer surface of the outer cylinder, said temperature detecting device being disposed in said terminal assembly.

* * * * *

UNITED STATES PATENT AND TRADEMARK OFFICE

CERTIFICATE OF CORRECTION

PATENT NO. : 6,435,836 B1
DATED : August 20, 2002
INVENTOR(S) : Kobayashi et al.

It is certified that error appears in the above-identified patent and that said Letters Patent is hereby corrected as shown below:

Title page,
Item [86], should read as follows:
-- [86] PCT No.: PCT/JP99/00499

§ 371 (c)(1),
(2), (4) Date: Sep. 7, 2000 --

Signed and Sealed this

Eighth Day of June, 2004

JON W. DUDAS
*Acting Director of the United States Patent and Trademark Office*